US009502781B2

(12) United States Patent
Battarov et al.

(10) Patent No.: US 9,502,781 B2
(45) Date of Patent: Nov. 22, 2016

(54) WIDEBAND BASE STATION ANTENNA RADIATOR

(71) Applicant: ACE TECHNOLOGIES CORPORATION, Incheon (KR)

(72) Inventors: Ilnar Battarov, Incheon (KR); Chul-Keun Park, Gyeonggi-do (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 176 days.

(21) Appl. No.: 14/458,084

(22) Filed: Aug. 12, 2014

(65) Prior Publication Data

US 2015/0048988 A1 Feb. 19, 2015

(30) Foreign Application Priority Data

Aug. 13, 2013 (KR) ..... 10-2013-0096103

(51) Int. Cl.

| | |
|---|---|
| ***H01Q 21/26*** | (2006.01) |
| ***H01Q 1/24*** | (2006.01) |
| ***H01Q 9/16*** | (2006.01) |
| *H01Q 21/08* | (2006.01) |

(52) U.S. Cl.

CPC ..... *H01Q 21/26* (2013.01); *H01Q 1/246* (2013.01); *H01Q 9/16* (2013.01); *H01Q 21/08* (2013.01)

(58) Field of Classification Search

CPC ..... H01Q 21/26; H01Q 21/08
USPC ..... 343/797, 799, 802, 807, 820, 821
See application file for complete search history.

(56) References Cited

U.S. PATENT DOCUMENTS

| | | | | |
|---|---|---|---|---|
| 6,034,649 | A * | 3/2000 | Wilson | H01Q 1/246 343/795 |
| 6,650,301 | B1 * | 11/2003 | Zimmerman | H01Q 9/26 343/795 |
| 7,075,498 | B2 * | 7/2006 | Gottl | H01Q 1/246 343/797 |
| 8,760,356 | B2 * | 6/2014 | Bu | H01Q 21/08 343/799 |
| 2004/0252071 | A1 * | 12/2004 | Bisiules | H01P 5/103 343/797 |
| 2007/0229385 | A1 * | 10/2007 | Deng | H01Q 1/246 343/797 |
| 2013/0187822 | A1 * | 7/2013 | Shi | H01Q 1/246 343/821 |

FOREIGN PATENT DOCUMENTS

| | | | |
|---|---|---|---|
| KR | 1020020034820 | A | 5/2002 |
| KR | 1020080020311 | A | 5/2008 |

* cited by examiner

*Primary Examiner* — Huedung Mancuso
(74) *Attorney, Agent, or Firm* — TechLaw LLP

(57) ABSTRACT

A radiator for a base station antenna is disclosed. The disclosed radiator includes a feed part and a multiple number of radiation elements configured to receive feed signals provided from the feed part, where each of the radiation elements comprises a first conductive part, which is fed with a + signal from the feed part, and a second conductive part, which is fed with a − signal from the feed part, and where a first expanding part that gradually increases in horizontal width along a direction of increasing distance from the first conductive part is joined to an end of the first conductive part, and a second expanding part that gradually increases in horizontal width along a direction of increasing distance from the second conductive part is joined to an end of the second conductive part.

6 Claims, 9 Drawing Sheets

WIDEBAND BASE STATION ANTENNA RADIATOR

CROSS-REFERENCE TO RELATED APPLICATIONS

This application claims the benefit of Korean Patent Application No. 10-2013-0096103, filed with the Korean Intellectual Property Office on Aug. 13, 2013, the disclosure of which is incorporated herein by reference in its entirety.

BACKGROUND

1. Technical Field

The present invention relates to a radiator for a base station antenna that transmits signals to terminals and receives and processes signals from terminals.

2. Description of the Related Art

A base antenna is an antenna that communicates with terminals that are present within a predetermined area and is generally installed in a high location such as on a building or on a mountain to exchange signals with terminals.

With recent increases in data transmissions for wireless communication services using mobile communication, so too is the need for high quality information transfer increasing. As the demand for wireless communication rapidly increases and as communication services are provided in faster speeds, there is a need to provide wideband properties.

In step with such trends, the implementation of wideband properties is also being required of the base station antenna, which is installed in a high location to communicate with terminals.

Although wideband properties have been achieved for base station antennas by using changes in matching circuits, changes in the structures of the reflective plates, and the like, there is a limit to the degree of wideband properties that can be achieved by such changes in consideration of the varying bandwidth used in current times.

SUMMARY

An aspect of the invention is to provide a base station antenna that can provide wideband properties.

One aspect of the invention provides a base station antenna that includes a feed part and a multiple number of radiation elements configured to receive feed signals provided from the feed part, where each of the radiation elements comprises a first conductive part, which is fed with a + signal from the feed part, and a second conductive part, which is fed with a − signal from the feed part, and where a first expanding part that gradually increases in horizontal width along a direction of increasing distance from the first conductive part is joined to an end of the first conductive part, and a second expanding part that gradually increases in horizontal width along a direction of increasing distance from the second conductive part is joined to an end of the second conductive part.

The first expanding part and the second expanding part may gradually increase in vertical width along the direction of increasing distance from the first conductive part and the second conductive part, respectively.

A first contracting part may be joined to the first expanding part, where the first contracting part may gradually decrease in width, and a second contracting part may be joined to the second expanding part, where the second contracting part may gradually decrease in width.

The combination of the first expanding part and the first contracting part and the combination of the second expanding part and the second contracting part may have a diamond shape.

A first slot may be formed in the combination of the first expanding part and the first contracting part, and a second slot may be formed in the combination of the second expanding part and the second contracting part.

The base station antenna radiator may further include a connecting member that connects the first contracting part and the second contracting part.

The vertical width of the first contracting part and the second contracting part may remain unchanged.

Another aspect of the invention provides a base station antenna that includes a feed part and a multiple number of radiation elements configured to receive feed signals provided from the feed part, where each of the radiation elements comprises a first conductive part, which is fed with a + signal from the feed part, and a second conductive part, which is fed with a − signal from the feed part, and where a first expanding part that gradually increases in vertical width along a direction of increasing distance from the first conductive part is joined to an end of the first conductive part, and a second expanding part that gradually increases in vertical width along a direction of increasing distance from the second conductive part is joined to an end of the second conductive part.

According to an aspect of the invention, wideband properties can be obtained with a simple structure.

Additional aspects and advantages of the present invention will be set forth in part in the description which follows, and in part will be obvious from the description, or may be learned by practice of the invention.

DETAILED DESCRIPTION

Figure 1:
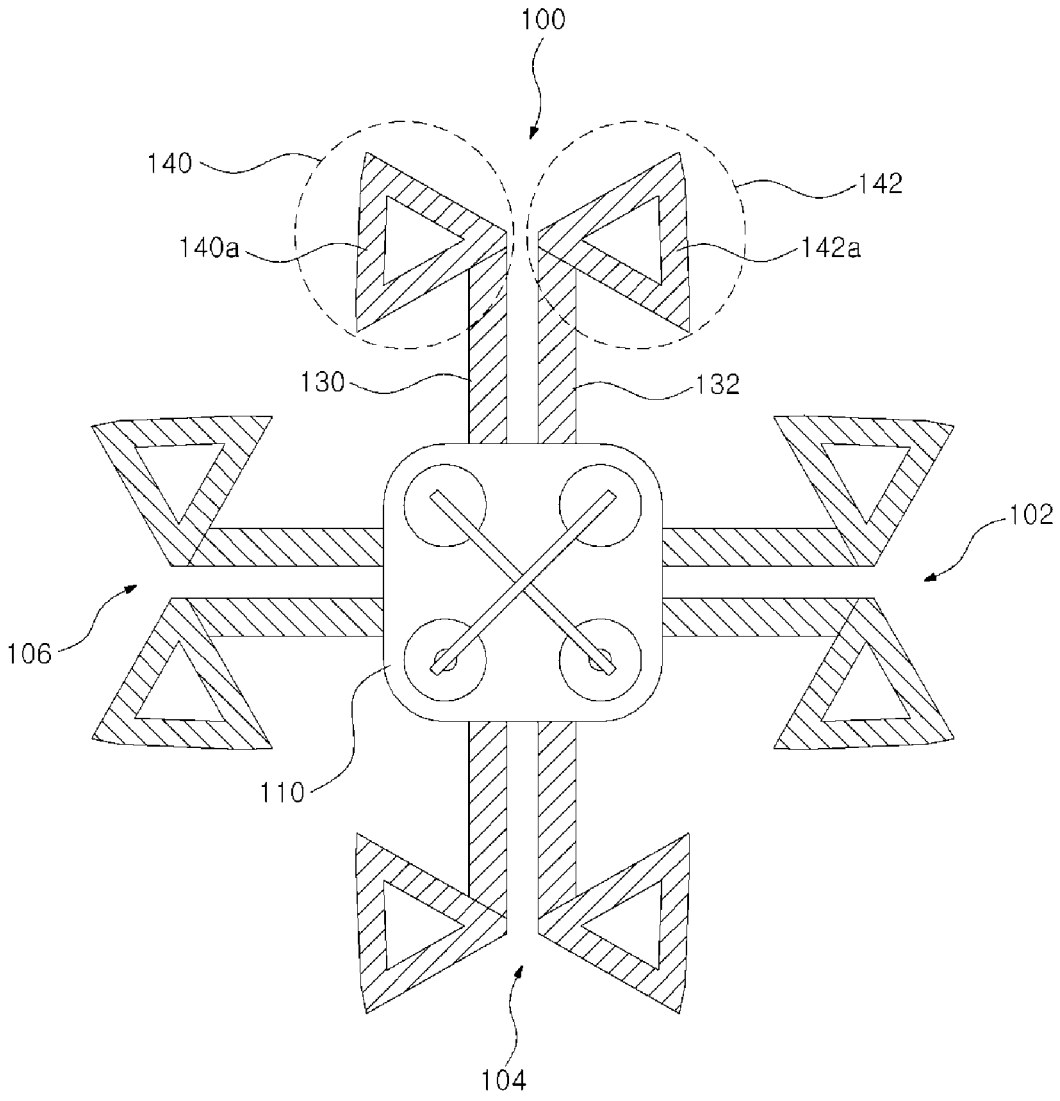
FIG. 1 is a plan view of a radiator used in a base station antenna according to a first disclosed embodiment of the invention.

As the present invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In the written description, certain detailed explanations of related art are omitted when it is deemed that they may unnecessarily obscure the essence of the present invention.

FIG. 1 is a plan view of a radiator used in a base station antenna according to a first disclosed embodiment of the invention.

Referring to FIG. 1, the radiator of a base station antenna according to the first disclosed embodiment of the invention may include four radiation elements 100, 102, 104, 106 and a feed part 110. Each radiation element 100, 102, 104, 106 may have the same form.

Each radiation element 100, 102, 104, 106 may operate as a dipole radiator and may radiate signals of a preset direction of polarization. The polarized signals of each radiation element 100, 102, 104, 106 may be synthesized, and the radiator illustrated FIG. 1 may radiate signals having a polarization of +45 degrees and −45 degrees by the vector synthesis of polarization. As the technology associated with radiating signals having a polarization of +45 degrees and −45 degrees by vector synthesis is commonly known, the description of the vector synthesis operation is omitted here.

Each radiation element 100, 102, 104, 106 may include a first conductive part 130 and a second conductive part 132. The first conductive part 130 may be fed with + signals from the feed part 110 and may be structured to extend along a particular direction. The second conductive part 132 may be fed with − signals from the feed part 110 and may be structured to extend in the same direction as the first conductive part 130 while separated by a particular distance from the first conductive part 130. The first conductive part 130 and the second conductive part 132 may be fed with + signals and − signals, respectively, to function as parts of a dipole radiator.

At the far end of the first conductive part 130, a first expanding part 140 may be formed that joins the first conductive part 130. Also, at the far end of the second conductive part 132, a second expanding part 142 may be formed that joins the second conductive part 132.

The first expanding part 140 may be structured such that the horizontal width gradually increases, and the second expanding part 142 likewise may be structured such that the horizontal width gradually increases. The first expanding part 140 and the second expanding part 142 can be made symmetrical, but the invention is not thus limited.

The first expanding part 140 and the second expanding part 142 can have a triangular structure, with the horizontal width gradually increasing. Of course, the first expanding part 140 and the second expanding part 142 are not limited to triangular forms, and can have any structure in which the horizontal width is made to increase gradually.

Slots 140*a*, 142*a* may be formed in the first expanding part 140 and second expanding part 142. The slots 140*a*, 142*a* may be formed in order to reduce the weight of the radiation element.

By virtue of the expanding parts 140, 142, of which the horizontal widths are broadened gradually from the ends of the conductive parts 130, 132 that are fed with + signals and − signals, respectively, and also by virtue of the vertical cross sections of the radiation elements described later on, an embodiment of the invention can provide wider band properties compared to a regular base station antenna.

Figure 2:
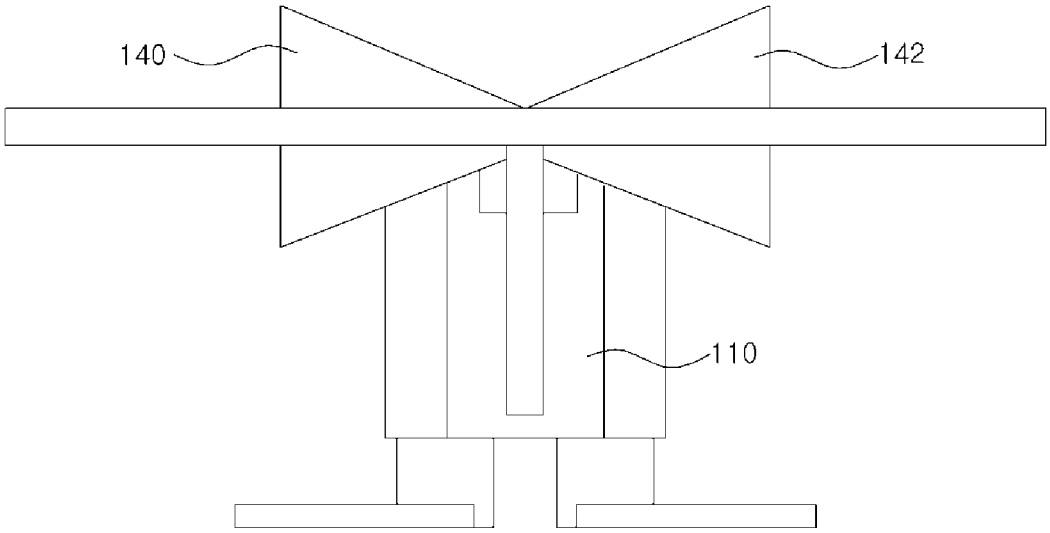
FIG. 2 is a cross-sectional view of a radiator according to the first disclosed embodiment of the invention.

FIG. 2 is a cross-sectional view of a radiator according to the first disclosed embodiment of the invention.

Referring to FIG. 2, the expanding parts 140, 142 in a radiation element according to the first disclosed embodiment of the invention may be structured such that their vertical widths are gradually increased also. That is, the first expanding part 140 and the second expanding part 142 of the radiation element may be structured such that the vertical widths are continuously increased as they extend further away from the ends of the conductive parts, with the greatest vertical widths reached at the ends of the respective expanding parts 140, 142.

Figure 3:
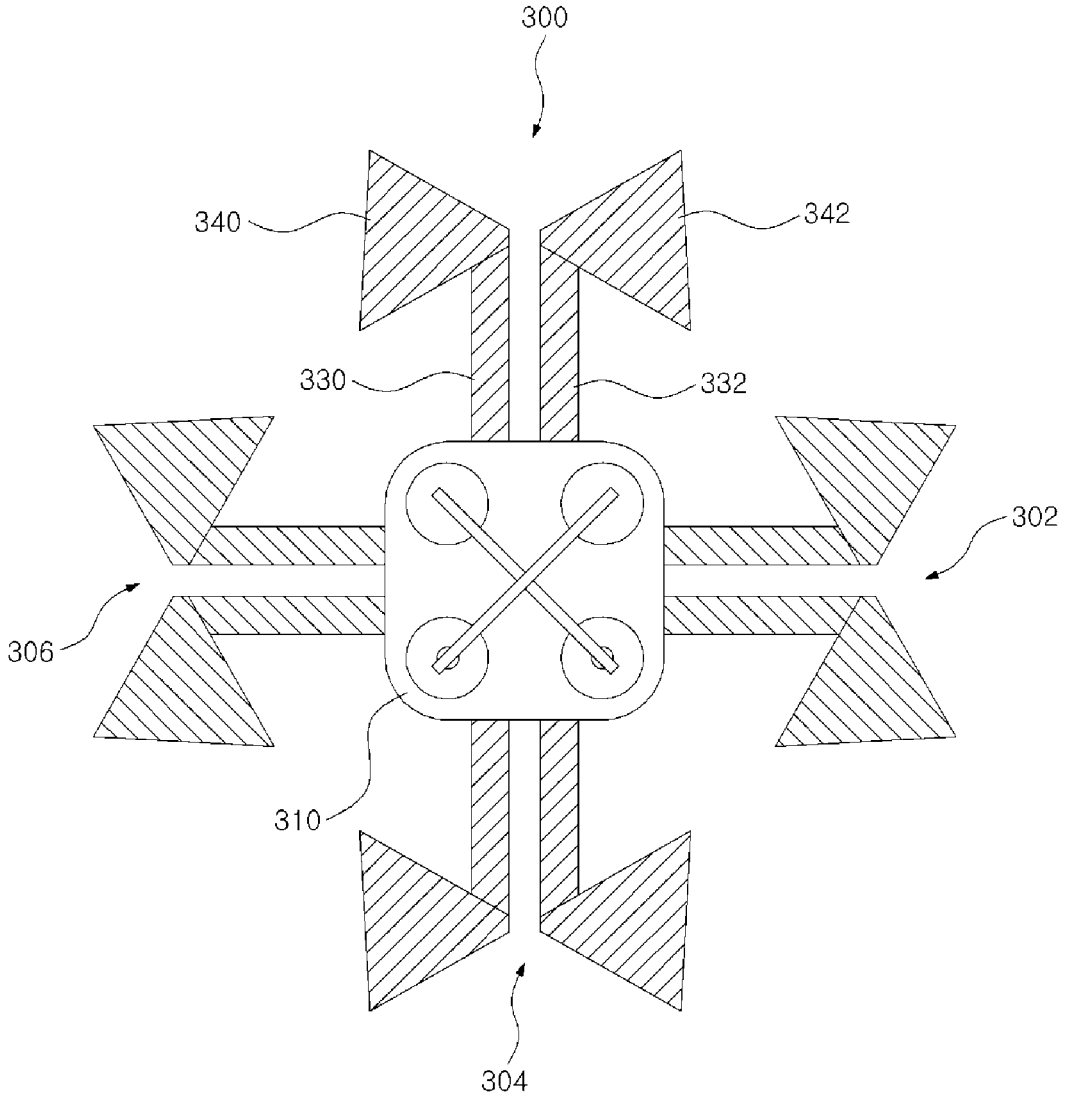
FIG. 3 is a plan view of a radiator used in a base station antenna according to a second disclosed embodiment of the invention.

FIG. 3 is a plan view of a radiator used in a base station antenna according to a second disclosed embodiment of the invention.

Referring to FIG. 3, the radiator of a base station antenna according to the second disclosed embodiment of the invention may include four radiation elements 300, 302, 304, 306 and a feed part 310. Each radiation element 300, 302, 304, 306 may have the same form.

The radiation elements 300, 302, 304, 306 illustrated in FIG. 3 may also operate as dipole radiators and may radiate signals of +45-degree or −45-degree polarization by vector synthesis.

Each radiation element 300, 302, 304, 306 may include a first conductive part 330 and a second conductive part 332. The first conductive part 330 may be fed with + signals from the feed part 110 and may be structured to extend along a particular direction. The second conductive part 332 may be fed with − signals from the feed part 310 and may be structured to extend in the same direction as the first conductive part 330 while separated by a particular distance from the first conductive part 330. The first conductive part 330 and the second conductive part 332 may be fed with + signals and − signals, respectively, to function as parts of a dipole radiator.

A first expanding part 340 may be joined at the far end of the first conductive part 330, while a second expanding part 342 may be joined at the far end of the second conductive part 332.

Unlike the first disclosed embodiment illustrated in FIG. 1, the radiator of the second disclosed embodiment may be structured such that its inside is full, without having slots formed therein. Although this approach of not forming slots may result in a greater weight for the antenna, in certain cases, it may be possible to provide a smaller size for the radiator.

That is, the matter of whether slots are to be formed as in the first disclosed embodiment or whether slots are not to be formed as in the second disclosed embodiment can be decided appropriately in correspondence to the required weight and the radiated frequencies.

The vertical cross section of the radiation element of an antenna based on the second disclosed embodiment may be the same as that shown in FIG. 2, which is the vertical cross section of a radiation element based on the first disclosed embodiment. An antenna according to either the first disclosed embodiment or the second disclosed embodiment may have a structure in which the horizontal cross section and the vertical cross section increase gradually by way of the expanding parts, and this enables the antenna to operate at a wider bandwidth.

Figure 4:
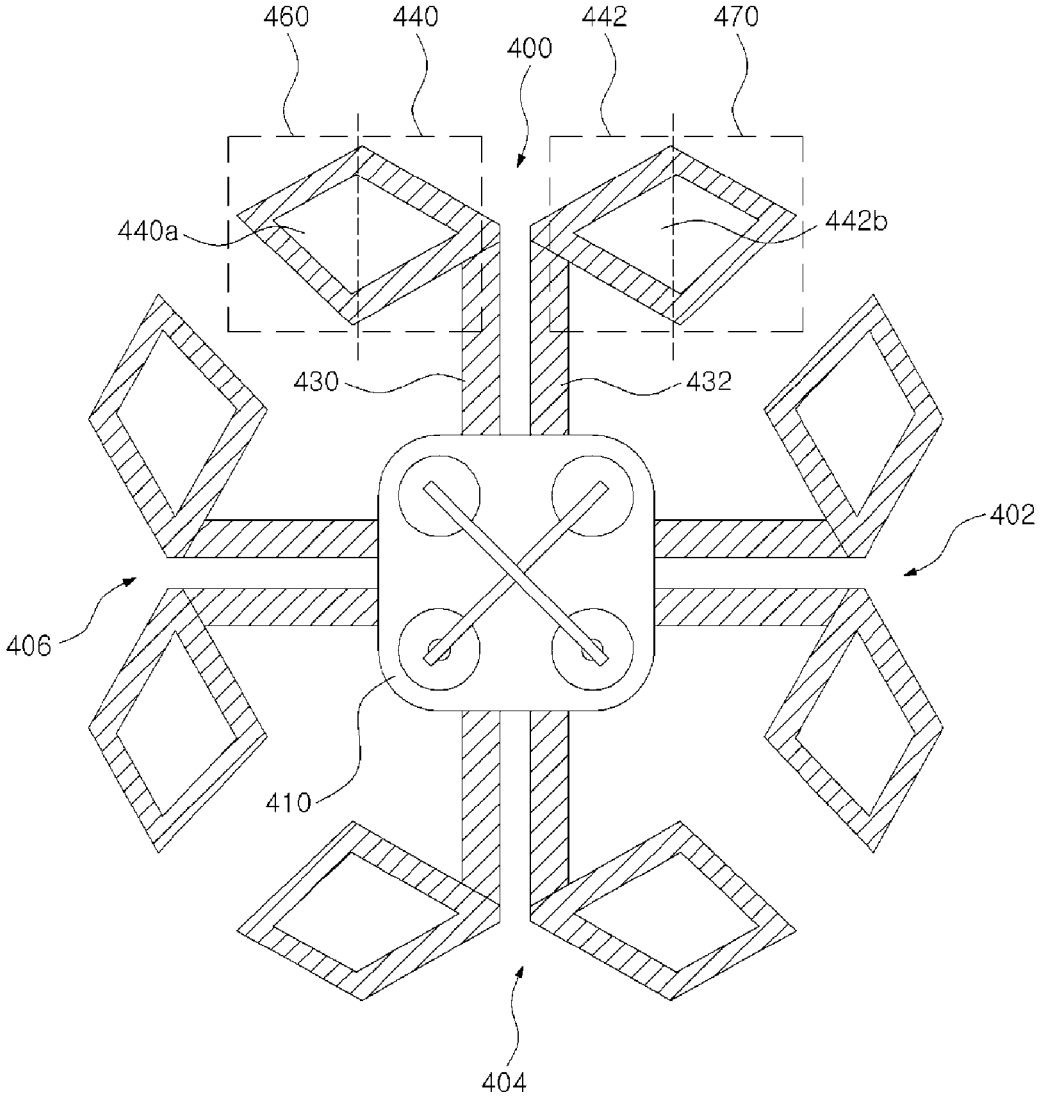
FIG. 4 is a plan view of a radiator used in a base station antenna according to a third disclosed embodiment of the invention.

FIG. 4 is a plan view of a radiator used in a base station antenna according to a third disclosed embodiment of the invention.

Referring to FIG. 4, the radiator of a base station antenna according to the third disclosed embodiment of the invention may include four radiation elements 400, 402, 404, 406 and a feed part 410. Each radiation element 400, 402, 404, 406 may have the same form.

The radiation elements 400, 402, 404, 406 illustrated in FIG. 4 may also operate as dipole radiators and may radiate signals of +45-degree or −45-degree polarization by vector synthesis.

Each radiation element 400, 402, 404, 406 may include a first conductive part 430 and a second conductive part 432. The first conductive part 430 may be fed with + signals from the feed part 410 and may be structured to extend along a particular direction. The second conductive part 432 may be fed with − signals from the feed part 410 and may be structured to extend in the same direction as the first conductive part 430 while separated by a particular distance from the first conductive part 430. The first conductive part 330 and the second conductive part 332 may be fed with + signals and − signals, respectively, to function as parts of a dipole radiator.

A first expanding part 440 may be joined at the far end of the first conductive part 430, while a second expanding part 442 may be joined at the far end of the second conductive part 432. The first expanding part 440 may be structured such that its horizontal width increases as it extends further away from the end of the first conductive part 430, and also, the second expanding part 442 may be structured such that its horizontal width increases as it extends further away from the end of the second conductive part 432.

A first contracting part 460 may be joined to the first expanding part 440, where the first contracting part 460 may gradually decreases the horizontal width of the first expanding part 440 which has been gradually increased. The first contracting part 460 may have a shape that is opposite to that of the first expanding part 440, so that the first expanding part 440 and the first contracting part 460 joined together may form a diamond shape.

A second contracting part 470 may be joined to the second expanding part 442, where the second contracting part 470 may gradually decreases the horizontal width of the second expanding part 442 which has been gradually increased. The second contracting part 470 may also have a shape that is opposite to that of the second expanding part 442, so that the second expanding part 442 and the second contracting part 470 joined together may also form a diamond shape.

The radiation frequency of a radiator may be determined by the length of the radiator, but if the lengths of the first expanding part 440 and second expanding part 442 were to be increased continuously in order to obtain a suitable radiation frequency, they may collide with other radiation elements or may be positioned very close to other radiation elements. If a radiation element is positioned close to another radiation element, the radiation properties can be distorted by unintended coupling. Therefore, once a desired bandwidth is obtained, the contracting parts 460, 470 may be formed to provide the desired radiation frequency while maintaining a distance from the other radiation elements.

The sizes of the expanding parts 440, 442 and the contracting parts 460, 470 can be determined according to the desired radiation frequency and bandwidth. A first slot 440*a* may be formed in the first expanding part 440 and first contracting part 460. The shape of the first slot 440*a* can correspond to the diamond shape formed by the joining of the first expanding part 440 and first contracting part 460 but is not limited thus.

A second slot 442*a* may be formed in the second expanding part 442 and second contracting part 470 also, and the shape of the second slot 442*a* can correspond to the diamond shape formed by the joining of the second expanding part 442 and the second contracting part 470 but is not limited thus.

The slots formed in the expanding parts 440, 442 and the contracting parts 460, 470 may serve to reduce the weight of the base station antenna without greatly affecting the radiation properties.

Figure 5:
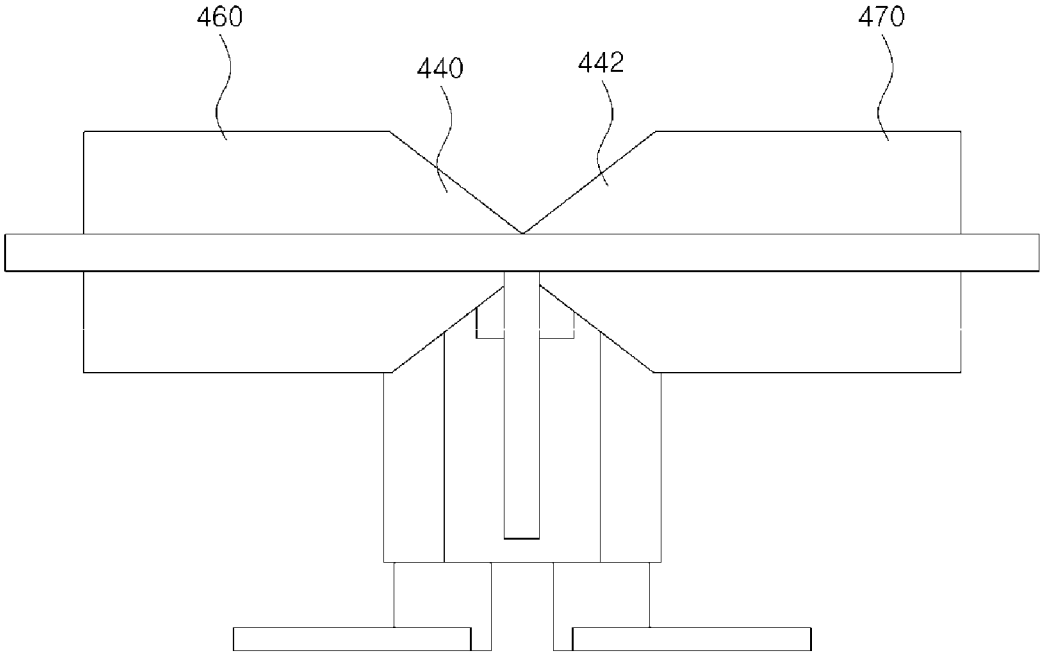
FIG. 5 is a vertical cross-sectional view of a radiator in a base antenna according to the third disclosed embodiment of the invention.

FIG. 5 is a vertical cross-sectional view of a radiator in a base antenna according to the third disclosed embodiment of the invention.

Referring to FIG. 5, the expanding parts 440, 442 may be structured such that their vertical widths also increase along the directions of increasing distance from the conductive parts 430, 432. However, the vertical cross section may increase only up to a predetermined point, beyond which the vertical cross section may be kept constant.

The gradual increasing of the vertical cross section up to a predetermined point is also for obtaining a wide band, and the point up to which the cross section is to be increased continuously may be determined based on the required bandwidth and size.

Figure 6:
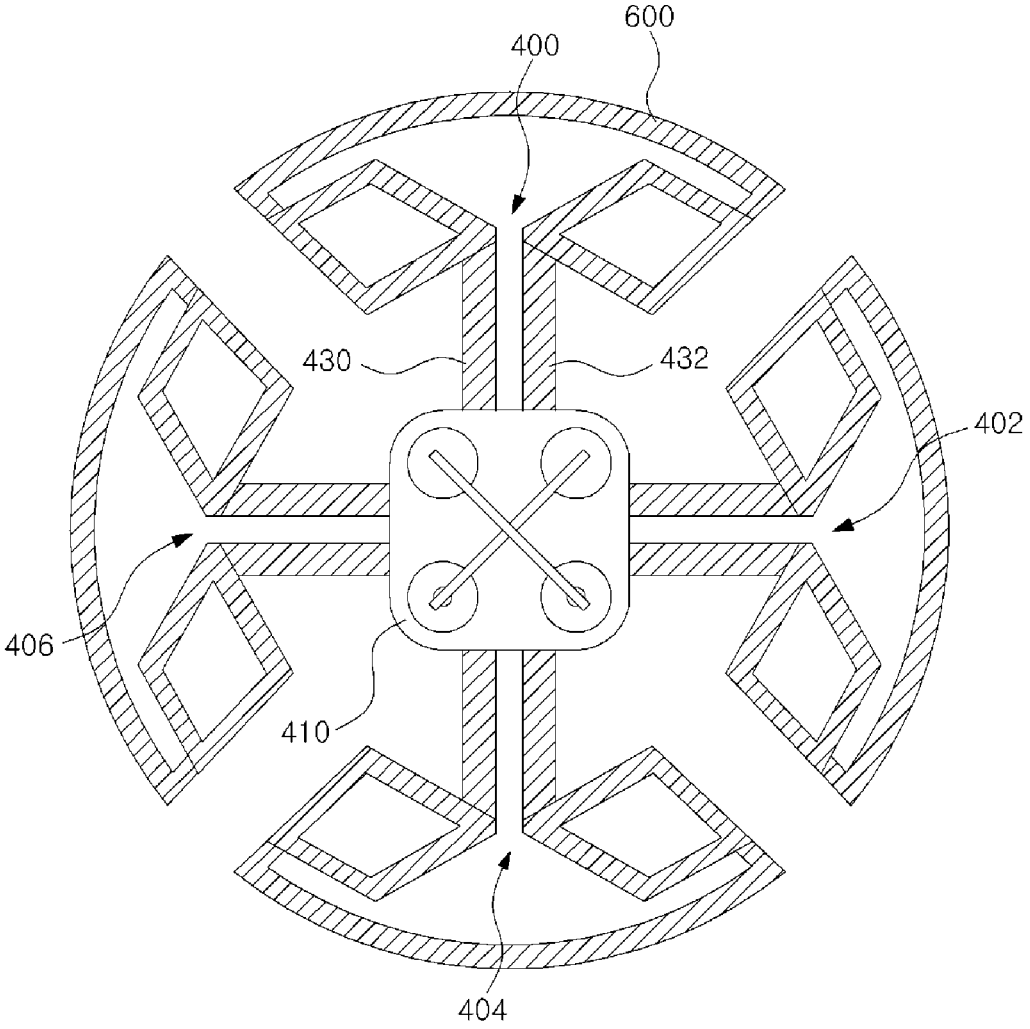
FIG. 6 is a plan view of a radiator used in a base station antenna according to a fourth disclosed embodiment of the invention.

FIG. 6 is a plan view of a radiator used in a base station antenna according to a fourth disclosed embodiment of the invention.

Referring to FIG. 6, a radiator used in a base station antenna according to the fourth disclosed embodiment of the invention may further include a connecting member 600 in addition to the radiator according to the third disclosed embodiment.

In FIG. 6, one end of the connecting member 600 is joined to the end of the first contracting part 460, and the other end of the connecting member 600 is joined to the end of the second contracting part 470, thereby electrically connecting the first contracting part 460 and the second contracting part 470.

The first contracting part 460 and the second contracting part 470 may extend from the first conductive part 430 and the second conductive part 432 respectively, and the connecting member 600 may hence serve to electrically connect the first conductive part 430 and the second conductive part 432.

The connecting member 600 may be included for impedance matching, and in cases where there are no problems in impedance matching, the connecting member 600 can be omitted.

The vertical cross section of a radiation element based on the fourth disclosed embodiment can have substantially the same structure as the vertical cross section of a radiation element based on the fourth disclosed embodiment of the invention.

Figure 7:
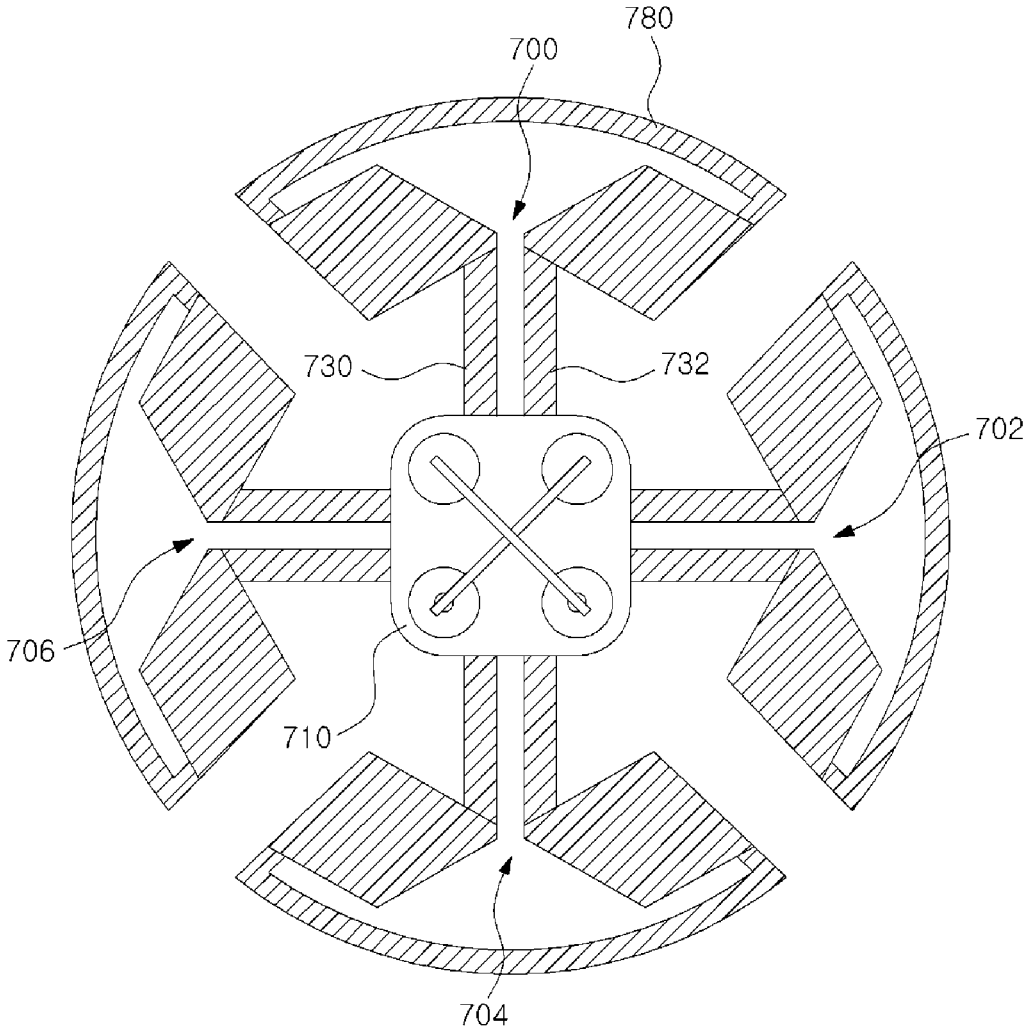
FIG. 7 is a plan view of a radiator used in a base station antenna according to a fifth disclosed embodiment of the invention.

FIG. 7 is a plan view of a radiator used in a base station antenna according to a fifth disclosed embodiment of the invention.

Referring to FIG. 7, a radiator according to the fifth disclosed embodiment of the invention may have a structure similar to that of the radiator according to the fourth disclosed embodiment but without the slots formed therein. In cases where the weight of the antenna is not an important issue, it is possible to obtain wideband properties with the slots omitted, as in the fifth disclosed embodiment illustrated in FIG. 7.

Figure 8:
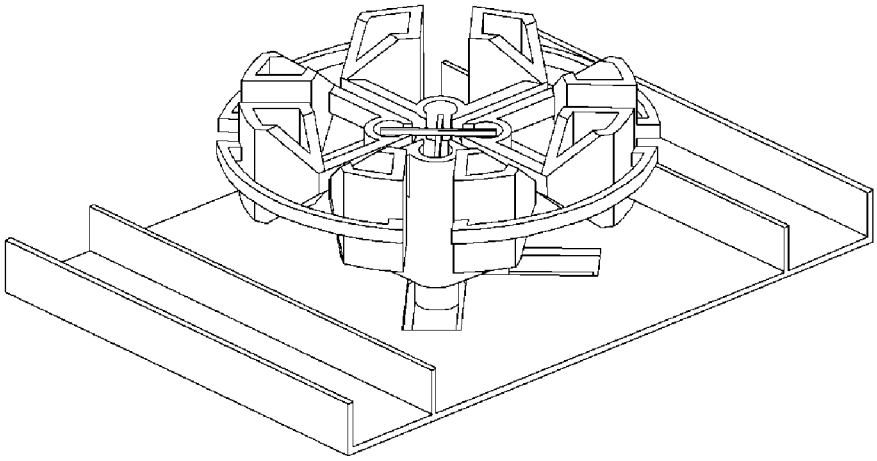
FIG. 8 is a perspective view of a radiator used in a base station antenna according to the fourth disclosed embodiment of the invention.

FIG. 8 is a perspective view of a radiator used in a base station antenna according to the fourth disclosed embodiment of the invention.

Referring to FIG. 8, the four radiation elements 400, 402, 404, 406 forming the radiator may each include expanding parts 440, 442 and contracting parts 460, 470, and it can be seen in the perspective view that the vertical cross sections of the expanding parts 440, 442 are gradually increased as well.

As for the contracting parts 460, 470, the horizontal cross sections gradually decrease, but the vertical cross sections are kept constant.

Figure 9:
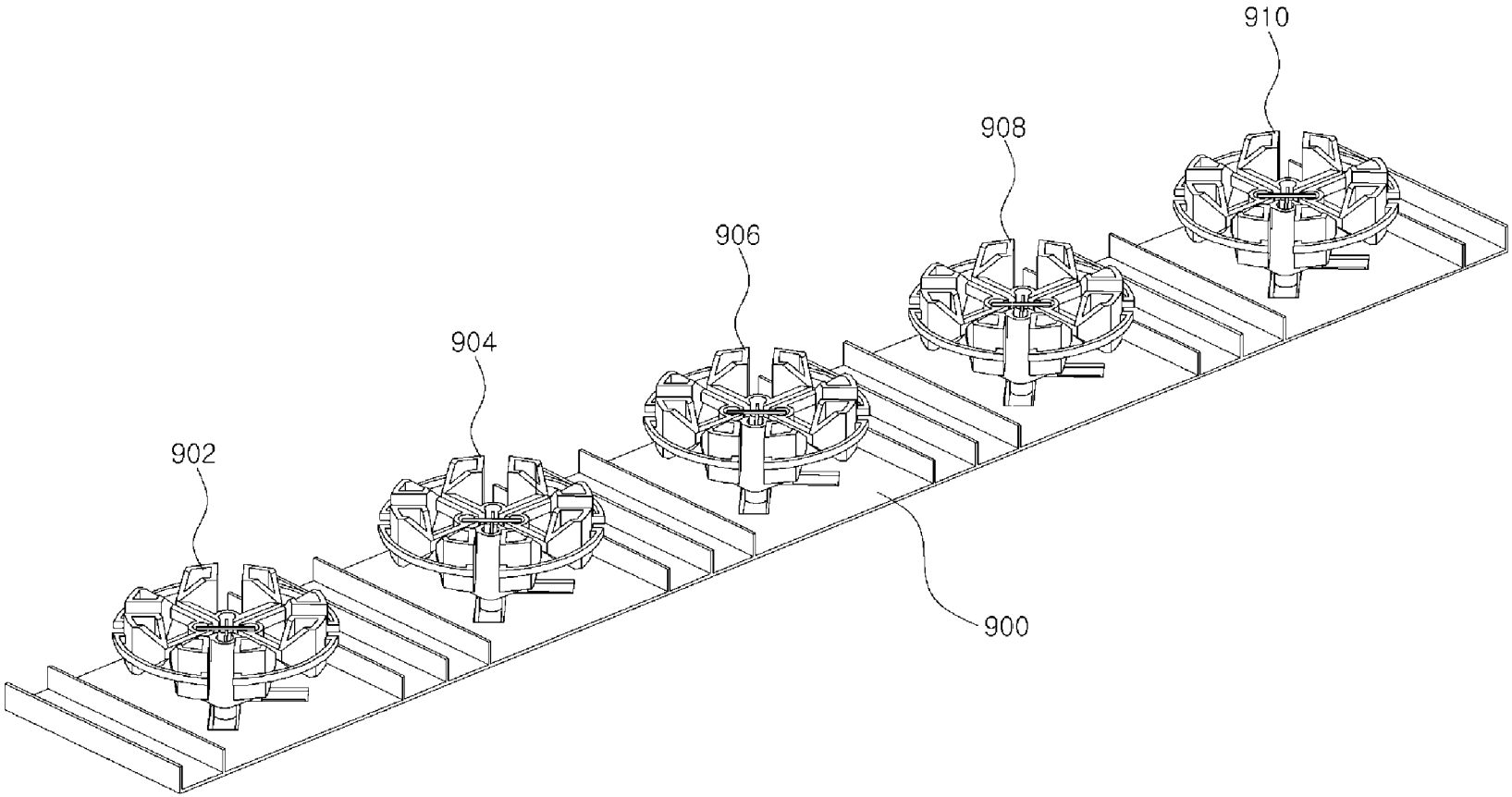
FIG. 9 illustrates a base station array antenna structure having radiators based on the fourth disclosed embodiment of the invention.

FIG. 9 illustrates a base station array antenna structure having radiators based on the fourth disclosed embodiment of the invention.

Referring to FIG. 9, a base station array antenna that utilizes a radiator according to an embodiment of the invention may be structured to have several radiators 902, 904, 906, 908, 910 arranged over a reflective plate 900.

Signals having different phases may be fed to the multiple radiators 902, 904, 906, 908, 910, and the beam patterns of the signals radiated from the array antenna can be adjusted by a phase adjustment of the signals that are fed.

While the present invention has been described above using particular examples, including specific elements, by way of limited embodiments and drawings, it is to be appreciated that these are provided merely to aid the overall understanding of the present invention, the present invention is not to be limited to the embodiments above, and various modifications and alterations can be made from the disclosures above by a person having ordinary skill in the technical field to which the present invention pertains. Therefore, the spirit of the present invention must not be limited to the embodiments described herein, and the scope of the present invention must be regarded as encompassing not only the claims set forth below, but also their equivalents and variations.

What is claimed is:

1. A base station antenna radiator comprising:

a feed part; and a plurality of radiation elements configured to receive feed signals provided from the feed part, wherein each of the plurality of radiation elements comprises a first conductive part and a second conductive part, the first conductive part fed with a + signal from the feed part, the second conductive part fed with a − signal from the feed part, a first expanding part is joined to an end of the first conductive part, the first expanding part gradually increasing in horizontal width along a direction of increasing distance from the first conductive part, a second expanding part is joined to an end of the second conductive part, the second expanding part gradually increasing in horizontal width along a direction of increasing distance from the second conductive part, wherein the first expanding part has a first contracting part joined thereto, the first contracting part gradually decreasing in width, and the second expanding part has a second contracting part joined thereto, the second contracting part gradually decreasing in width.

2. The base station antenna radiator of claim 1, wherein the first expanding part and the second expanding part gradually increase in vertical width along the direction of increasing distance from the first conductive part and the second conductive part, respectively.

3. The base station antenna radiator of claim 1, wherein a combination of the first expanding part and the first contracting part and a combination of the second expanding part and the second contracting part have a diamond shape.

4. The base station antenna radiator of claim 3, wherein the combination of the first expanding part and the first contracting part has a first slot formed therein, and the combination of the second expanding part and the second contracting part has a second slot formed therein.

5. The base station antenna radiator of claim 1, further comprising a connecting member connecting the first contracting part and the second contracting part.

6. The base station antenna radiator of claim 1, wherein the first contracting part and the second contracting part do not change in vertical width.

* * * * *